US008259045B2

(12) United States Patent
Ahn et al.

(10) Patent No.: US 8,259,045 B2
(45) Date of Patent: Sep. 4, 2012

(54) FLAT PANEL DISPLAY

(75) Inventors: Byungchul Ahn, Seoul (KR); Jongsang Baek, Kyungbuk (KR); Seungchul Park, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 828 days.

(21) Appl. No.: 12/318,391

(22) Filed: Dec. 29, 2008

(65) Prior Publication Data

US 2009/0251394 A1 Oct. 8, 2009

(30) Foreign Application Priority Data

Apr. 3, 2008 (KR) ..... 10-2008-0031399

(51) Int. Cl.
*G09G 3/34* (2006.01)

(52) U.S. Cl. ..... 345/84; 345/173

(58) Field of Classification Search ..... 345/84, 345/173, 472, 660
See application file for complete search history.

(56) References Cited

U.S. PATENT DOCUMENTS

| | | | | |
|---|---|---|---|---|
| 4,584,524 | A * | 4/1986 | Tomany | 324/73.1 |
| 5,583,531 | A * | 12/1996 | Okada et al. | 345/89 |
| 2003/0071829 | A1* | 4/2003 | Bodicker et al. | 345/619 |
| 2005/0264589 | A1* | 12/2005 | Kimoto et al. | 345/698 |
| 2007/0236566 | A1* | 10/2007 | Chan et al. | 348/87 |
| 2009/0209350 | A1* | 8/2009 | Kelly et al. | 463/42 |
| 2011/0126255 | A1* | 5/2011 | Perlman et al. | 725/116 |
| 2011/0292287 | A1* | 12/2011 | Washington | 348/571 |
| 2011/0310247 | A1* | 12/2011 | Rensin et al. | 348/143 |

* cited by examiner

*Primary Examiner* — Ricardo L Osorio
(74) *Attorney, Agent, or Firm* — Morgan, Lewis & Bockius LLP

(57) ABSTRACT

A flat panel display is disclosed. The flat panel display includes a display panel including data lines, gate lines crossing the data lines, pixels arranged in a matrix format, and a pixel array that allows images to be simultaneously displayed on one screen by suitably disposing the images on one screen, a data drive circuit supplying data to the data lines, a gate drive circuit supplying scan signals to the gate lines, a scalar board converting a resolution of each of the images, and a control board that supplies data received from the scalar board to the data drive circuit and controls operation timing of the data drive circuit and operation timing of the gate drive circuit. a ratio of a horizontal length to a vertical length of the pixel array is 21.3-26.7:10.

15 Claims, 7 Drawing Sheets

FLAT PANEL DISPLAY

This application claims the benefit of Korea Patent Application No. 10-2008-0031399 filed on Apr. 3, 2008, which is incorporated herein by reference for all purposes as if fully set forth herein.

BACKGROUND OF THE INVENTION

1. Field of the Invention

An exemplary embodiment of the invention relates to a flat panel display such as a liquid crystal display (LCD), a field emission display (FED), a plasma display panel (PDP), and an organic light emitting display (OLED).

2. Discussion of the Related Art

Active matrix type liquid crystal displays display a moving picture using a thin film transistor (TFT) as a switching element. The active matrix type liquid crystal displays have been implemented televisions as well as display devices in portable devices, such as office equipment and computers, because of the thin profile of the active matrix type liquid crystal displays. Accordingly, cathode ray tubes (CRT) are being replaced by active matrix type liquid crystal displays.

The liquid crystal display includes a pixel array in which a plurality of pixels each including R subpixel, G subpixel and B subpixel are arranged in a matrix format. As shown in FIG. 1, a resolution of the pixel array is determined depending on the number "x" of pixels in a horizontal direction and the number "y" of pixels in a vertical direction. Currently, a resolution applied to a monitor of a personal computer or a monitor of a notebook computer is as follows.

TABLE 1

| Resolution | x | y | Ratio | |
|---|---|---|---|---|
| VGA | 640 | 480 | 4 | 3 |
| SVGA | 800 | 600 | 4 | 3 |
| XGA | 1024 | 768 | 4 | 3 |
| XGA+ | 1152 | 864 | 4 | 3 |
| WXGA | 1280 | 800 | 16 | 10 |
| SXGA | 1280 | 1024 | 5 | 4 |
| WXGA+ | 1440 | 900 | 16 | 10 |
| UXGA | 1600 | 1200 | 4 | 3 |
| WSXGA+ | 1680 | 1050 | 16 | 10 |
| WUXGA | 1920 | 1200 | 16 | 10 |
| QXGA | 2048 | 1536 | 4 | 3 |
| WQXGA | 2560 | 1600 | 16 | 10 |
| QSXGA | 2560 | 2048 | 5 | 4 |
| WQSXGA | 3200 | 2048 | 25 | 16 |
| QUXGA | 3200 | 2400 | 4 | 3 |
| WQUXGA | 3800 | 2400 | 16 | 10 |

If one or more applications are run in the liquid crystal display having the above resolution to display two or more images in a multi-window manner, the following problems occur.

If entire images of first and second windows W1 and W2 are displayed on one screen, a display surface indicted in black cannot be used as shown in FIG. 2. Accordingly, the utilization of the display surface is reduced. The reason is that when the two entire images are displayed on one screen, the size of each of the two entire images is reduced while vertical and horizontal resolutions of each of the two entire images are maintained.

As shown in FIGS. 3 and 4, if the size of one or all of the first and second windows W1 and W2 increases, only a portion of the image on the size increasing window is enlarged. In this case, a vertical scrollbar and/or a horizontal scrollbar appear in the size increasing window so as to move the images. A user can entirely view the image on the size increasing window by repeatedly dragging the scrollbar using a mouse. Therefore, the efficiency of a work using a monitor with the existing resolution is reduced.

A problem related to the existing resolution occurs in a field emission display (FED), a plasma display panel (PDP), and an organic light emitting display (OLED) as well as a liquid crystal display.

SUMMARY OF THE INVENTION

An exemplary embodiment of the invention provides a liquid crystal display capable of increasing the utilization of a display surface and displaying two or more entire images without a scrollbar when the two or more images are displayed on one screen.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, a flat panel display comprises a display panel including a plurality of data lines, a plurality of gate lines crossing the plurality of data lines, and a pixel array including a plurality of pixels arranged in a matrix format that allows a plurality of images to be simultaneously displayed on one screen by suitably disposing the plurality of images on one screen, a data drive circuit that supplies data to the data lines, a gate drive circuit that supplies scan signal to the gate lines, a scalar board that converts a resolution of each of the plurality of images, and a control board that supplies data received from the scalar board to the data drive circuit and controls operation timing of the data drive circuit and operation timing of the gate drive circuit, wherein a ratio of a horizontal length to a vertical length of the pixel array is 21.3-26.7:10.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail embodiments of the invention examples of which are illustrated in the accompanying drawings.

Figure 1:
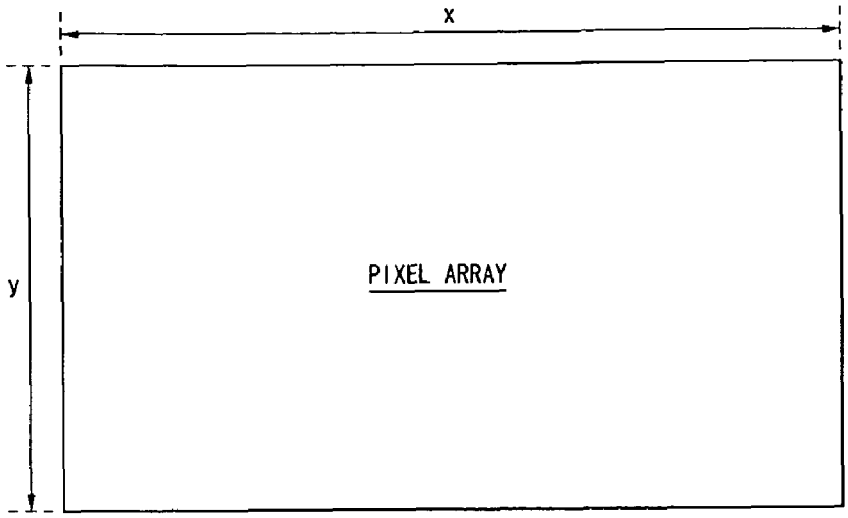
FIG. 1 (Related Art)
FIG. 1 is a diagram showing a resolution of a liquid crystal display.
Figure 2:
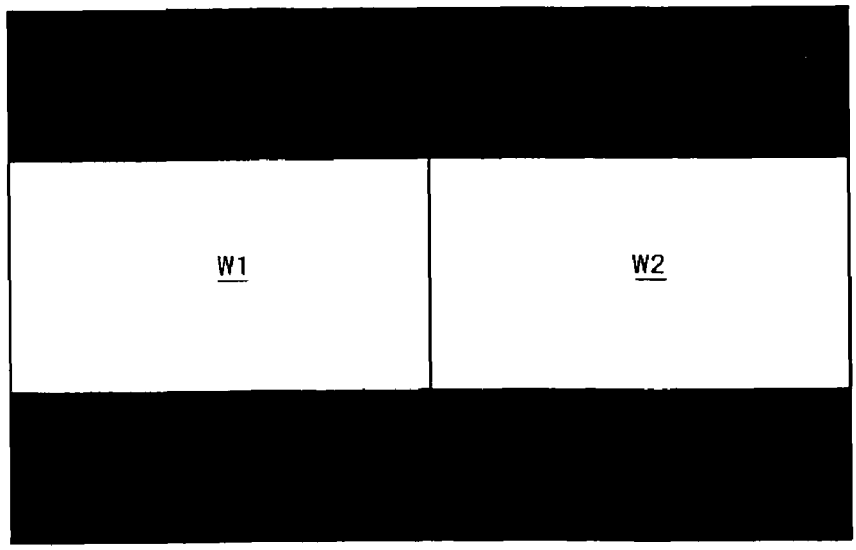
FIG. 2 (Related Art)
FIGS. 2 to 4 show examples where two images are displayed in a multi-window manner in a resolution applied to a related art liquid crystal display.
Figure 3:
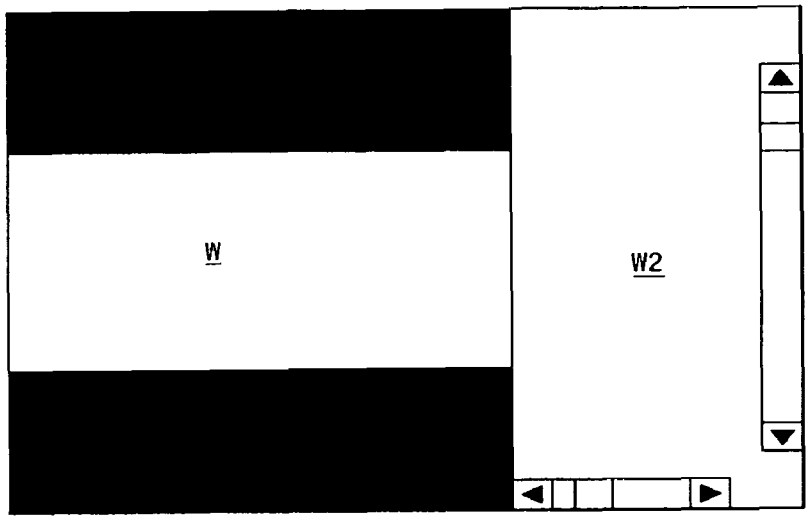
FIG. 3 (Related Art)
Figure 4:
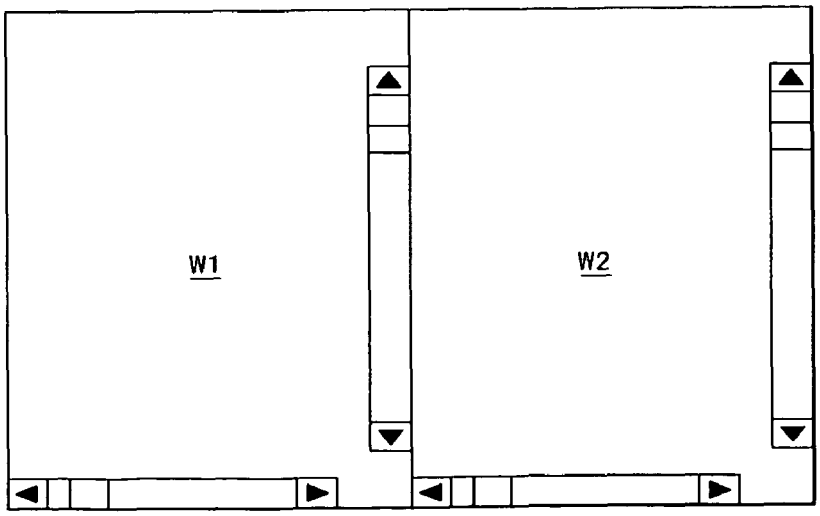
FIG. 4 (Related Art)
Figure 5:
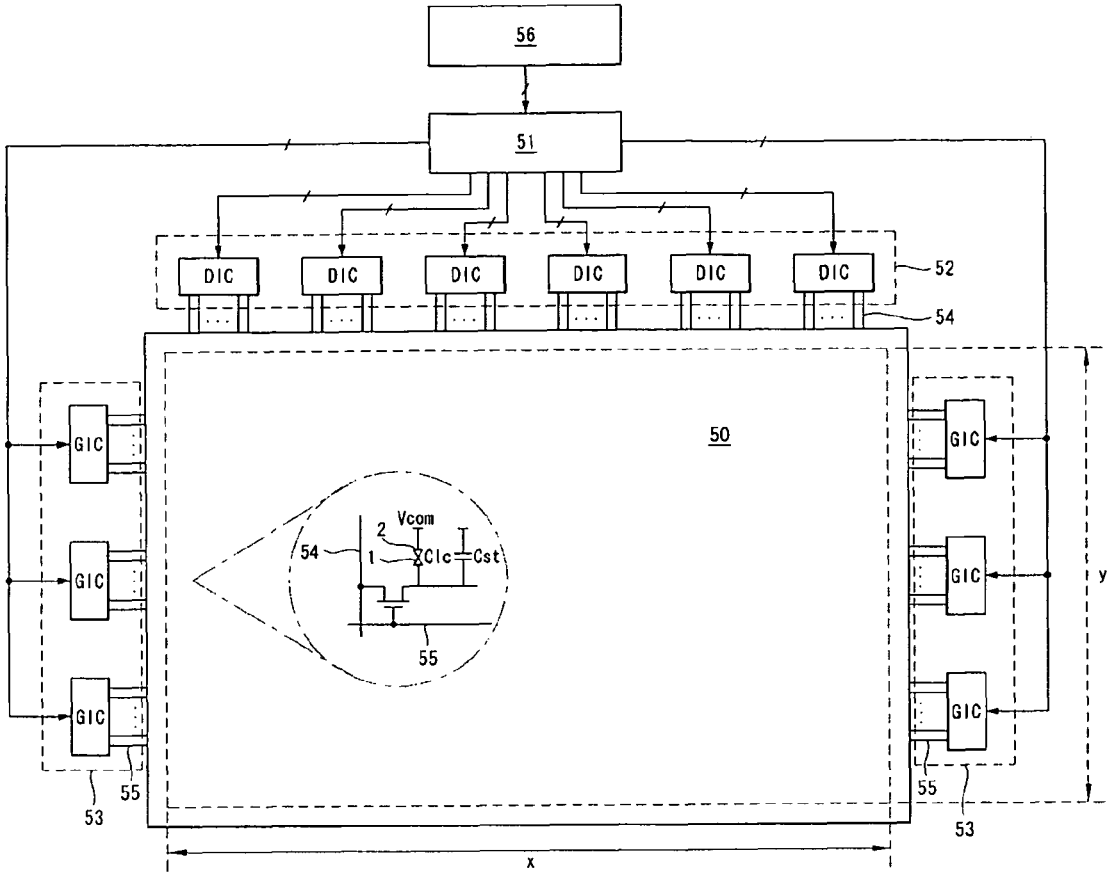
FIG. 5 shows a flat panel display according to a first exemplary embodiment of the invention.

As shown in FIG. 5, a flat panel display according to a first exemplary embodiment of the invention includes a liquid crystal display panel 50, a control board 51, a data drive circuit 52, a gate drive circuit 53, and a scalar board 56.

The liquid crystal display panel 50 includes an upper glass substrate, a lower glass substrate, and a liquid crystal layer between the upper and lower glass substrates. The liquid crystal display panel 50 includes liquid crystal cells Clc arranged in a matrix format at each crossing of data lines 54 and gate lines 55.

The data lines 54, the gate lines 55, thin film transistors (TFTs), and a storage capacitor Cst are formed on the lower glass substrate of the liquid crystal display panel 50. The liquid crystal cells Clc are connected to the TFTs and driven by an electric field between pixel electrodes 1 and common electrodes 2. A black matrix, a color filter, and the common electrodes 2 are formed on the upper glass substrate of the liquid crystal display panel 50. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates are attached respectively to the upper and lower glass substrates of the liquid crystal display panel 50. Alignment layers for setting a pre-tilt angle of liquid crystal are respectively formed on the upper and lower glass substrates.

A resolution of the liquid crystal display panel 50 is defined by a ratio a ratio of a horizontal length "x" to a vertical length "y" of the pixel array. The ratio is 21.3-26.7:10. The resolution was obtained by repeatedly conducting an experiment in which various applications such as a movie program, a game program and a document program are run, and then 2 or 3 images of 2 or 3 windows are simultaneously displayed on one screen. If three images are simultaneously displayed in the resolution of 21.3-26.7:10, an unused display surface is small or little. 2 or more entire images can be simultaneously displayed on one screen without a scrollbar.

The data drive circuit 52 includes a plurality of data driver integrated circuits (ICs) connected between the control board 51 and the data lines 54 of the liquid crystal display panel 50. Each of the data driver ICs includes a shift resistor, a latch, a digital-to-analog converter, an output buffer, and the like. Each data driver IC latches digital video data received from the control board 51 in response to a data timing control signal received from the control board 51. Then, each data driver IC converts the digital video data into analog positive and negative gamma compensation voltages to supply the analog positive and negative gamma compensation voltages to the data lines 54.

The gate drive circuit 53 includes a plurality of gate driver ICs on one side or both sides of the liquid crystal display panel 50. The gate driver ICs sequentially supply gate pulses, namely, scan pulses to the gate lines 55 in response to a gate timing control signal received from the control board 51. The gate pulses synchronize with data voltages supplied to the data lines 54.

The control board 51 divides the digital video data received from the scalar board 56 into display positions of the liquid crystal display panel 50 to supply the digital video data to the data driver ICs DIC. The control board 51 generates a data timing control signal for controlling operation timing of the data driver ICs DIC and a gate timing control signal for controlling operation timing of the gate driver ICs GIC based on a timing signal such as vertical and horizontal sync signals, a data enable signal, a dot clock signal received from the scalar board 56.

The scalar board 56 converts resolutions of the digital video data received from a plurality of image sources into resolutions of images displayed on the liquid crystal display panel 50 using a plurality of scalars each processing one image to supply the converted resolutions to the control board 51. The scalar board 56 supplies the timing signal such as the vertical and horizontal sync signals, the data enable signal, the dot clock signal to the control board 51.

Figure 6:
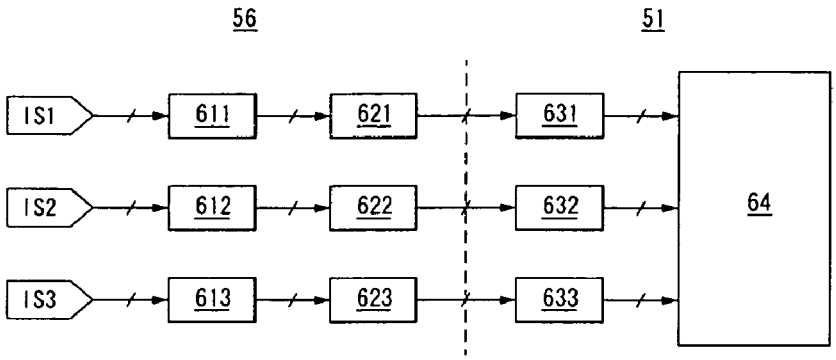
FIG. 6 shows a circuit configuration of a scalar board and a controller board.
Figure 7:
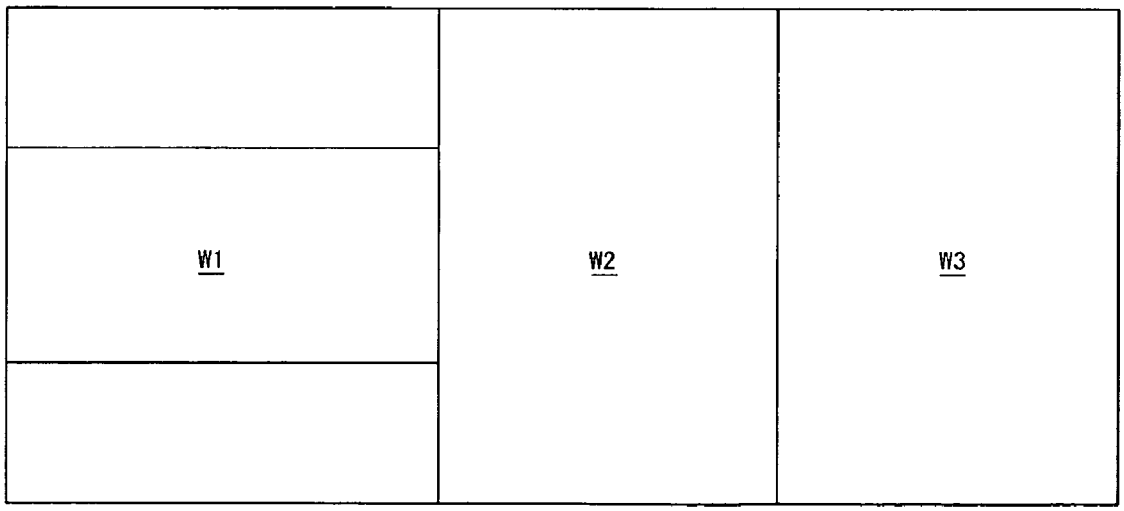
FIG. 7 shows an example of 3 images of 3 windows in a resolution of the flat panel display according to the first exemplary embodiment of the invention.

FIG. 6 shows a circuit configuration of the scalar board 56 and the controller board 51. FIG. 7 shows an example of 3 images of 3 windows displayed on the liquid crystal display panel 50.

In FIGS. 6 and 7, IS1 indicates a first image source generating digital video data of an image displayed on a first window W1, IS2 indicates a second image source generating digital video data of an image displayed on a second window W2, and IS3 indicates a third mage source generating digital video data of an image displayed on a third window W3. The image source includes a set-top box, a DVD player, a blue-ray player, a personal computer (PC), various applications run by the PC, and the like.

The scalar board 56 includes first to third scalars 611 to 613 and first to third interface transmitting units 621 to 623. The controller board 51 includes first to third interface receiving units 631 to 633 and a timing controller 64.

The first scalar 611 receives digital video data from the first image source IS1, converts a resolution of the digital video data into a resolution of an image displayed on the first window W1, and generates a timing signal based on the converted resolution. The second scalar 612 receives digital video data from the second image source IS2, converts a resolution of the digital video data into a resolution of an image displayed on the second window W2, and generates a timing signal based on the converted resolution. The third scalar 613 receives digital video data from the third image source IS3, converts a resolution of the digital video data into a resolution of an image displayed on the third window W3, and generates a timing signal based on the converted resolution.

The first interface transmitting unit 621 is connected between the first scalar 611 and the first interface receiving unit 631 to supply the digital video data and the timing signal received from the first scalar 611 to the first interface receiving unit 631. The second interface transmitting unit 622 is connected between the second scalar 612 and the second interface receiving unit 632 to supply the digital video data and the timing signal received from the second scalar 612 to the second interface receiving unit 632. The third interface transmitting unit 623 is connected between the third scalar 613 and the third interface receiving unit 633 to supply the digital video data and the timing signal received from the third scalar 613 to the third interface receiving unit 633. The digital video data and the timing signals are transmitted from the first to third interface transmitting units 621 to 623 to the first to third interface receiving units 631 to 633 in transition minimized differential signaling (TMDS) interface or low voltage differential signaling (LVDS) interface.

The timing controller 51 distributes the digital video data received from the first to third interface receiving units 631 to 633 to the data driver ICs DIC. The timing controller 51 generates the data timing control signal for controlling the operation timing of the data driver ICs DIC and the gate timing control signal for controlling the operation timing of the gate driver ICs GIC based on the timing signals received from the first to third interface receiving units 631 to 633. The digital video data included in the image of the first image source IS1 is supplied to the data driver ICs DIC that are positioned on left side of the liquid crystal display panel 50 to supply the data voltage to the data lines existing inside the first window W1. The digital video data included in the image of the second image source IS2 is supplied to the data driver ICs DIC that are positioned in the middle of the liquid crystal display panel 50 to supply the data voltage to the data lines existing inside the second window W2. The digital video data included in the image of the third image source IS3 is supplied to the data driver ICs DIC that are positioned on right side of the liquid crystal display panel 50 to supply the data voltage to the data lines existing inside the third window W3.

If two images are displayed on the pixel array of the liquid crystal display panel 50, resolutions of two image sources are converted and two of the first to third scalars 611 to 613 supply digital video data, whose resolution is converted, to the timing controller 63. There is no output to the scaler that does not receive the digital video data from an image source. In this case, the timing controller 64 supplies the digital video data received from one interface receiving unit to the data driver ICs for driving the data lines related to one of the two images, and supplies the digital video data received from the other interface receiving unit to the data driver ICs for driving the data lines related to the other image.

Figure 8:
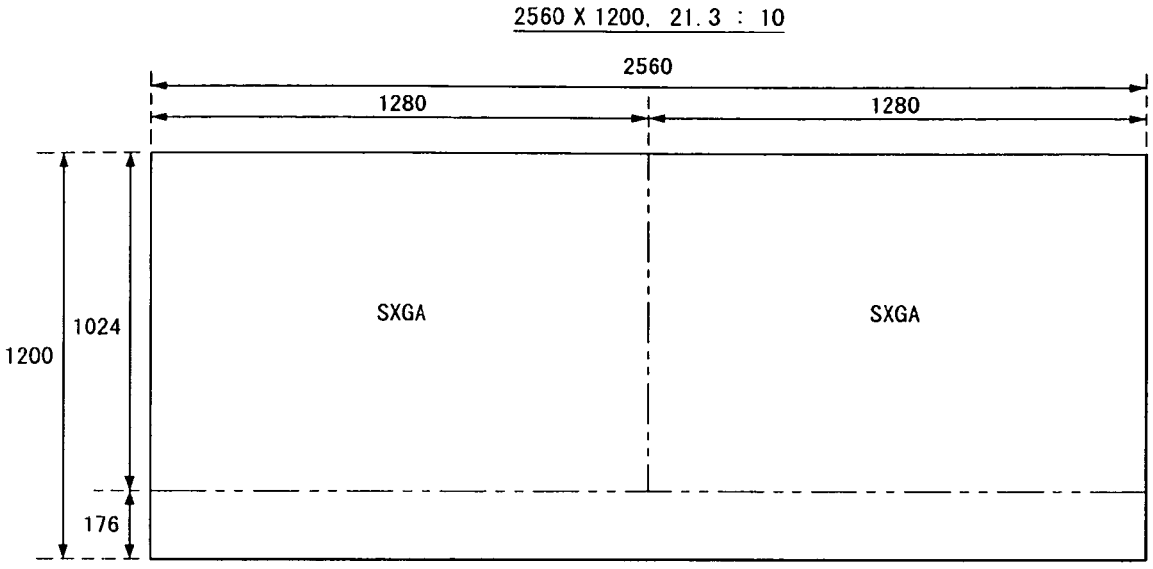
FIG. 8 shows an example of 2 images of 2 windows in a resolution of the flat panel display according to the first exemplary embodiment of the invention.

FIG. 8 shows an example of 2 images of 2 windows in a resolution of the flat panel display according to the first exemplary embodiment of the invention.

As shown in FIG. 8, the resolution of the flat panel display according to the first exemplary embodiment of the invention is 2560 (the number of pixels in a horizontal direction)×1200 (the number of pixels in a vertical direction), and a ratio of a horizontal length to a vertical length of the pixel array is 21.3:10. FIG. 8 shows two images each having SXGA resolution in the resolution of 21.3:10. The two images of SXGA resolution can dividedly occupy the entire surface of a display surface having the resolution of 21.3:10 and can be simultaneously displayed on the display surface. Accordingly, the two images of SXGA resolution can be simultaneously displayed on the flat panel display of the resolution of 21.3:10 without scrollbar.

Figure 9:
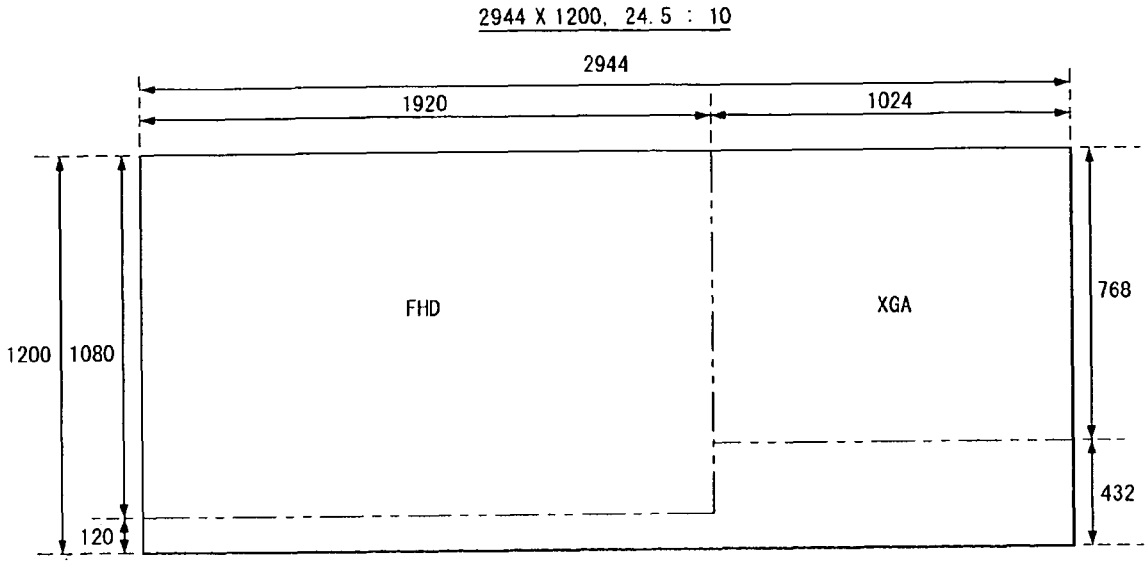
FIG. 9 shows an example of 2 images in a resolution of a flat panel display according to a second exemplary embodiment of the invention.

FIG. 9 shows an example of 2 images in a resolution of a flat panel display according to a second exemplary embodiment of the invention.

As shown in FIG. 9, a resolution of the flat panel display according to the second exemplary embodiment of the invention is 2944 (the number of pixels in a horizontal direction)× 1200 (the number of pixels in a vertical direction), and a ratio of the number of horizontal pixels to the number of vertical pixels is 24.5:10. FIG. 9 shows one image of full high definition (HD) resolution and one image of XGA resolution (1024×768) in the resolution of 24.5:10. The image of full HD resolution and the image of XGA resolution can dividedly occupy the entire surface of a display surface having the resolution of 24.5:10 and can be simultaneously displayed on the display surface. Accordingly, the image of full HD resolution and the image of XGA resolution can be simultaneously displayed on the flat panel display of the resolution of 24.5:10 without scrollbar.

Figure 10:
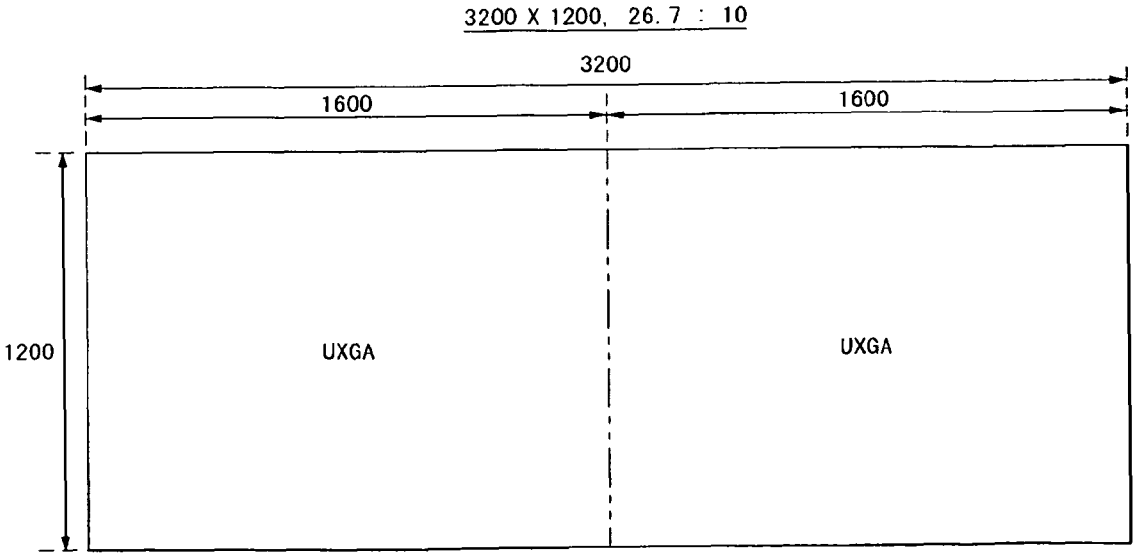
FIG. 10 shows an example of 2 images in a resolution of a flat panel display according to a third exemplary embodiment of the invention.

FIG. 10 shows an example of 2 images in a resolution of a flat panel display according to a third exemplary embodiment of the invention.

As shown in FIG. 10, a resolution of the flat panel display according to the third exemplary embodiment of the invention is 3200 (the number of pixels in a horizontal direction)×1200 (the number of pixels in a vertical direction), and a ratio of the number of horizontal pixels to the number of vertical pixels is 26.7:10. FIG. 10 shows two images each having UXGA resolution (1600×1200) in the resolution of 26.7:10. The two images of UXGA resolution can dividedly occupy the entire surface of a display surface having the resolution of 26.7:10 and can be simultaneously displayed on the display surface. Accordingly, the two images of UXGA resolution can be simultaneously displayed on the flat panel display of the resolution of 26.7:10 without scrollbar. The resolution allows the two images and a document program to be enlarged so that the screen is full of the 3 windows. Further, the resolution allows a document of 1 page with a resolution of A4 paper in each of the 3 windows to be displayed without a scrollbar.

The image resolution described in FIGS. 8 to 10 is not determined, and can select any one of the resolutions indicated in Table 1. The scalars convert a resolution of digital video data into a resolution suitable for a resolution of a display image.

Figure 11:
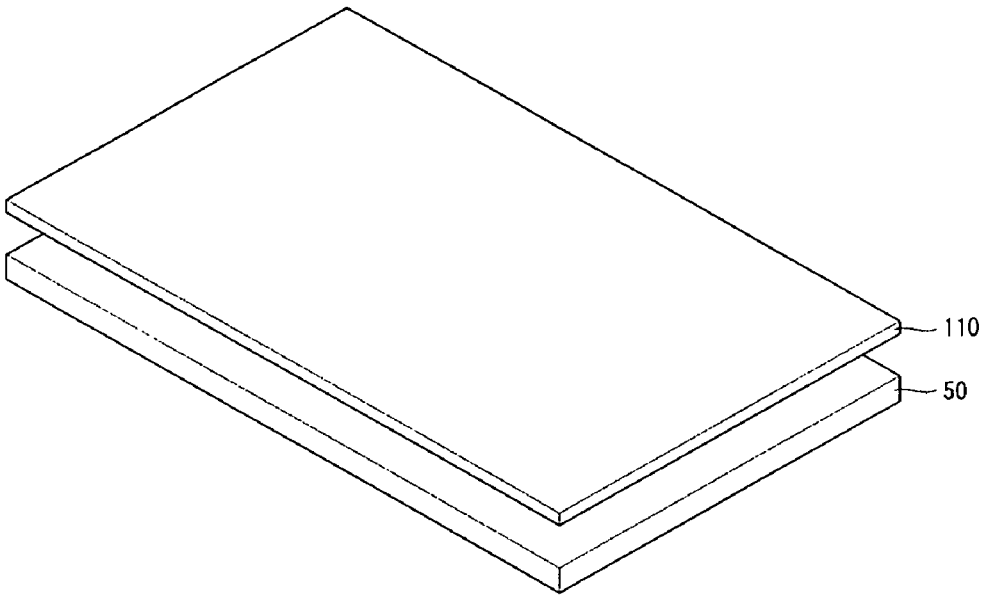
FIG. 11 shows a flat panel display according to the second exemplary embodiment of the invention.

FIG. 11 shows a flat panel display according to the second exemplary embodiment of the invention.

As shown in FIG. 11, the flat panel display according to the second exemplary embodiment of the invention includes a liquid crystal display panel 50 and a touch panel 110 on the liquid crystal display panel 50. The same circuit configuration as the flat panel display according to the first exemplary embodiment of the invention is omitted in FIG. 11.

The touch panel 110 may be manufactured using a well-known method, for example, a conductive film method (or a matrix switch method), a capacitance change method, an infrared light sensor matrix method, a metal thinning filling-up method, a resistance change (a conductive layer) method, a vibration delay time method, a load partial pressure (a pressure sensor) method, a surface wave (ultrasonic wave) reflective method, an optical waveguide method, a capacitance method. A touch signal sensed by the touch panel 110 is converted into xy-coordinate data by a touch processor (not shown). The xy-coordinate data receives an image from an external device such as a set-top box, a DVD player, a blue-ray player and is transmitted to a system board running an application.

Figure 12:
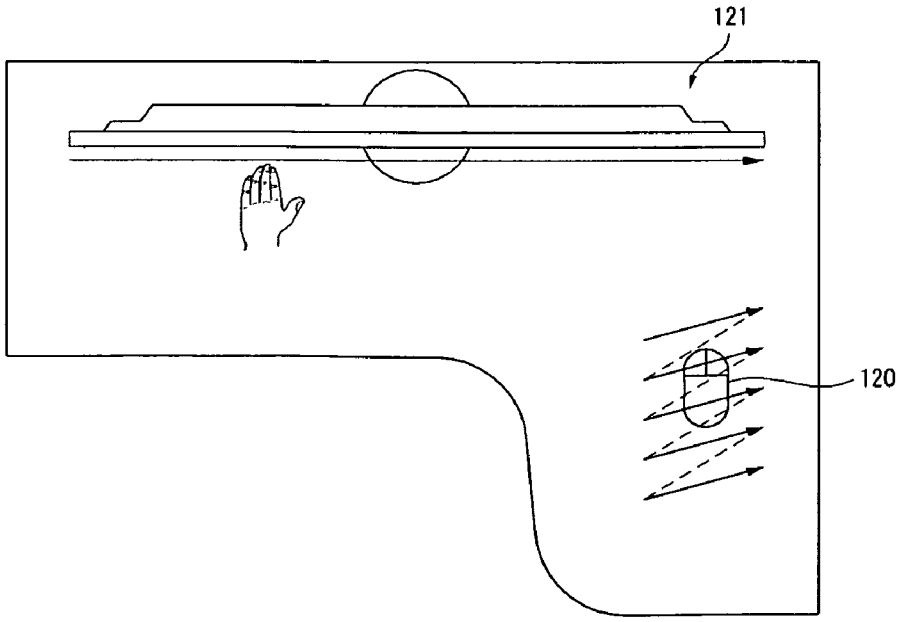
FIG. 12 shows a behavior of a user when a touch panel and a mouse are used as user interface.

The liquid crystal display panel 50 according to the second exemplary embodiment of the invention has a resolution of 21.3-26.7:10 as in the first exemplary embodiment. The liquid crystal display panel 50 according to the first and second exemplary embodiments has the horizontal pixels more than horizontal pixels of the existing resolution. If a user moves a display image, controls the size of the display image, or controls on- and off-operations of the display image using a mouse 120 as shown in FIG. 12, the user has to repeatedly move the mouse 120 in a horizontal direction. Therefore, a traffic line in the horizontal direction of the user becomes longer. Conversely, if the user controls the display image by bringing a user's finger or a touch pen into contact with the touch panel 110, the traffic line using the touch panel 110 is reduced to approximately one half of the traffic line using the mouse 120. In FIG. 12, a reference numeral 121 indicates a monitor having the liquid crystal display panel 50 and the touch panel 110 attached to the display surface of the liquid crystal display panel 50. Accordingly, it is advantageous that the liquid crystal display according to the exemplary embodiments of the invention uses the touch panel 110 as user interface because of the resolution of 21.3-26.7:10.

Although the exemplary embodiments have described the liquid crystal display as an example of the flat panel display, the above-described resolution may be applied to a field emission display (FED), a plasma display panel (PDP), an organic light emitting display (OLED), and the like.

The flat panel display according to the exemplary embodiments of the invention has the resolution of 21.3-26.7:10. The resolution allows two or more images to be displayed on one screen without a scrollbar while the unused display surface is little. Furthermore, because the flat panel display according to the exemplary embodiments of the invention can display two or more images on one screen without a scrollbar, the efficiency of a work using a monitor can be improved. Because the flat panel display according to the exemplary embodiments of the invention uses the touch panel as user interface, a traffic line of a user can shorten when the user wants to control an image.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A flat panel display, comprising:

a display panel including a plurality of data lines, a plurality of gate lines crossing the plurality of data lines, and a pixel array including a plurality of pixels arranged in a matrix format that allows a plurality of images to be simultaneously displayed on one screen without a scrollbar by suitably disposing the plurality of images on one screen;

a data drive circuit that supplies data to the data lines;

a gate drive circuit that supplies scan signal to the gate lines;

a scalar board that converts a resolution of each of the plurality of images; and a control board that supplies data received from the scalar board to the data drive circuit and controls operation timing of the data drive circuit and operation timing of the gate drive circuit, wherein a ratio of a horizontal length to a vertical length of the pixel array in the display panel is 21.3-26.7:10.

2. The flat panel display of claim 1, wherein the display panel is one of a liquid crystal display (LCD), a field emission display (FED), a plasma display panel (PDP), and an organic light emitting display (OLED).

3. The flat panel display of claim 2, wherein the ratio of a horizontal length to a vertical length of the pixel array is 21.3:10.

4. The flat panel display of claim 2, wherein the ratio of a horizontal length to a vertical length of the pixel array is 24.5:10.

5. The flat panel display of claim 2, wherein the ratio of a horizontal length to a vertical length of the pixel array is 26.7:10.

6. The flat panel display of claim 2, wherein, when the plurality of images are simultaneously displayed on the display panel, a whole page of each of the 2 or 3 images is simultaneously displayed on one screen without the scrollbar.

7. The flat panel display of claim 1, further comprising a touch panel attached to the display panel.

8. The flat panel display of claim 7, wherein the ratio of a horizontal length to a vertical length of the pixel array is 21.3:10.

9. The flat panel display of claim 7, wherein the ratio of a horizontal length to a vertical length of the pixel array is 24.5:10.

10. The flat panel display of claim 7, wherein the ratio of a horizontal length to a vertical length of the pixel array is 26.7:10.

11. The flat panel display of claim 7, wherein, when the plurality of images are simultaneously displayed on the display panel, a whole page of each of the 2 or 3 images is simultaneously displayed on one screen without the scrollbar.

12. The flat panel display of claim 1, wherein the ratio of a horizontal length to a vertical length of the pixel array is 21.3:10.

13. The flat panel display of claim 1, wherein the ratio of a horizontal length to a vertical length of the pixel array is 24.5:10.

14. The flat panel display of claim 1, wherein the ratio of a horizontal length to a vertical length of the pixel array is 26.7:10.

15. The flat panel display of claim 1, wherein, when the plurality of images are simultaneously displayed on the display panel, a whole page of each of the 2 or 3 images is simultaneously displayed on one screen without the scrollbar.

* * * * *